US006079301A

United States Patent [19]

Scolo

[11] Patent Number: 6,079,301

[45] Date of Patent: Jun. 27, 2000

[54] MULTI-WRENCH TOOL KIT

[75] Inventor: Robert M. Scolo, Elmont, N.Y.

[73] Assignee: Media Group, Stamford, Conn.

[21] Appl. No.: 08/868,871

[22] Filed: Jun. 4, 1997

[51] Int. Cl.[7] ..... B25B 23/16

[52] U.S. Cl. ..... 81/177.6

[58] Field of Search ..... 81/124.4, 125.1, 81/177.6; 7/118

[56] References Cited

U.S. PATENT DOCUMENTS

| | | | |
|---|---|---|---|
| 588,174 | 8/1897 | Praunegger . | |
| 1,001,530 | 8/1911 | Kaesen . | |
| 1,186,807 | 6/1916 | Litomy | 81/125.1 |
| 1,768,627 | 11/1930 | Plante . | |
| 2,804,970 | 5/1957 | Kuc et al. . | |
| 4,010,663 | 3/1977 | Rydberg . | |
| 4,269,311 | 5/1981 | Rich . | |
| 4,384,499 | 5/1983 | Shockley . | |
| 5,320,004 | 6/1994 | Hsiao . | |
| 5,450,774 | 9/1995 | Chang . | |

*Primary Examiner*—David A. Scherbel
*Assistant Examiner*—Benjamin M. Halpern
*Attorney, Agent, or Firm*—Evelyn M. Sommer

[57] ABSTRACT

A hand tool wrench set includes a plurality of wrenches rotatably mounted to one or more pivot pins. The tool includes an elongated body having a channel defining by a channel bottom and side walls. The wrenches comprise a shank portion and a working tip portion, such as a crescent or boxed end wrench tip. The pivot pin is slidably mounted through a longitudinal locking slot in the wrench shank. The longitudinal locking slot defines a proximate portion and a distal portion. The shank may freely rotate about the pivot pin when the pivot pin is positioned in the proximate portion of said slot, however, the shank is biased against the channel bottom when the pivot pin is positioned in the distal portion of the locking slot. This allows a user to fixedly secure the wrench to the hand tool and use the wrench in either a clockwise or counter clockwise manner without reversing the direction of the wrench.

2 Claims, 4 Drawing Sheets

MULTI-WRENCH TOOL KIT

FIELD OF INVENTION

This invention relates to hand tools and in particular to a hand tool set that has a number of different sized wrenches rotatably affixed to a handle thereof for ease of use and convenience.

BACKGROUND OF THE INVENTION

A variety of sizes of hand tools are often needed by craftspersons, and lay persons. For example, one often needs to have hand wrenches readily available in graduated sizes and shapes, as well as in both metric and SAE measurements. A number of vendors have attempted to address this issue by selling hand tools in packaging which the craftspersons may use to store and carry the hand tools. However, in time, individual tools are often misplaced. Additionally, it may become time consuming to re-sort or replace the individual wrenches in the proper holders. This is particularly true when the craftsperson is maintaining both metric and SAE measurement wrenches.

A number of inventors have attempted to solve this problem for hand tools in general. For example, U.S. Pat. No. 1,001,530 describes a gang wrench for holding a plurality of wrench members of graduated sizes and shapes. The gang wrench utilizes a bow or clip which allows the user to select and utilize a particular wrench while it is within the gang, or remove the wrench from the gang for independent use. The bow or clip, however, can be generally cumbersome to use and may loosen from use and also allows individual wrenches to be lost.

U.S. Pat. No. 4,269,311 attempted to address the issue by designing a hand held device in which a set of wrenches are pivotally mounted on a single pin in a housing. The housing includes a pivotally mounted cover and latch, and casing ends walls having fitted openings through which the shank of the selected wrench will extend. Wrenches are selected by opening the cover and pivoting the selected wrench about the pin. The cover is then closed and latched allowing the wrench shank to flatly engage with, and be securely clamped in by, the fitted openings in the casing walls. While this device, succeeds in maintaining the tools in a single hand held device, it is unnecessarily complicated to manufacture. Additionally, the latch may become a single point of failure for the entire device.

Other hand tool sets for key wrenches, screw drivers and the like have been developed. For example, U.S. Pat. Nos. 2,804,970 (the "'970 patent") and 5,450,774 (the "'774 patent") disclose an elongated U-shaped channel housing a plurality of hex wrenches, screw driver heads and the like pivotably mounted on a pair of pivot bolts or pins. These devices function to organize and provide enhanced holding of a plurality of selectable devices, such as hex wrenches and screw drivers, which are rotated 360-degrees about the longitudinal axis of the tool. The individual hex wrenches or screw driver heads are selected by simply pivoting the selected wrench about pivot bolts. The hex wrenches and screw driver heads remain free to pivot about the pivot bolts during use of the tool. U.S. Pat. No. 5,320,004 (the "'004 patent") also discloses a similar device in which similar hex wrenches, screw driver heads, and the like, are mounted on pivot bolts between two cover plates.

None of these patents (the '970, the '774 or the '004 patents), however, disclose a means for fixedly securing the individual wrenches, as would be desirable for the types of wrench heads utilized in the present invention (i.e. crescent end or box end wrenches). In fact, the '004 patent and the '774 patent each utilize an alternate means of incorporating a hand wrench function into the device. For example, the U-shaped housing of the '774 pacent includes a number of different sized polygon shaped holes formed on the bottom of the channel to serve as a wrench. The '004 patent includes a removable spanner having socket holes for turning bits, nuts and screws, which may be inserted between the cover plates. Alternatively, the '004 patent provides for a spanner having a wrench head which may be slidably mounted on the pivot bolt. The devices disclosed in the '004 patent and the '774 patent, however, offer only a limited range of sizes and functions.

It is, therefore, desirable to provide an improvement of such hand held tool sets which overcomes such deficiencies and securely mounts a variety of sizes of wrenches and similar devices.

SUMMARY OF THE INVENTION

It is an object of the invention to provide a tool set which can pivotably secure a plurality of tools in a hand held housing.

This, and other objectives, are achieved by providing a hand tool set comprising an elongated body having a generally U-shaped cross section defined by a bottom and a pair of side walls to provide a hollow space therebetween. In the preferred embodiment two pins are mounted across the pair of side walls near either end of the channel for rotatably supporting the shank end of the individual wrenches in such a way as to allow the wrenches to be rotatable between a first position where the wrenches are received within the hollow space and a second lockable position where the working heads of the wrenches are exposed. Alternatively, a single pin may be utilized. The shank of the wrenches is provided with a longitudinal locking slot which allows the wrench to rotate about the pin only when the pin is at one end of the slot. The wrench is secured when the pin is at the other end of the slot by sliding the wrench into the locked position, thereby biasing the curved end of the shank against the bottom of the U-shaped handle.

BRIEF DESCRIPTION OF THE DRAWINGS

The accompanying drawings illustrate several aspects of the present invention, and together with the description serve to explain the principles of the invention. In the drawings.

DETAILED DESCRIPTION OF THE INVENTION

Figure 1A:
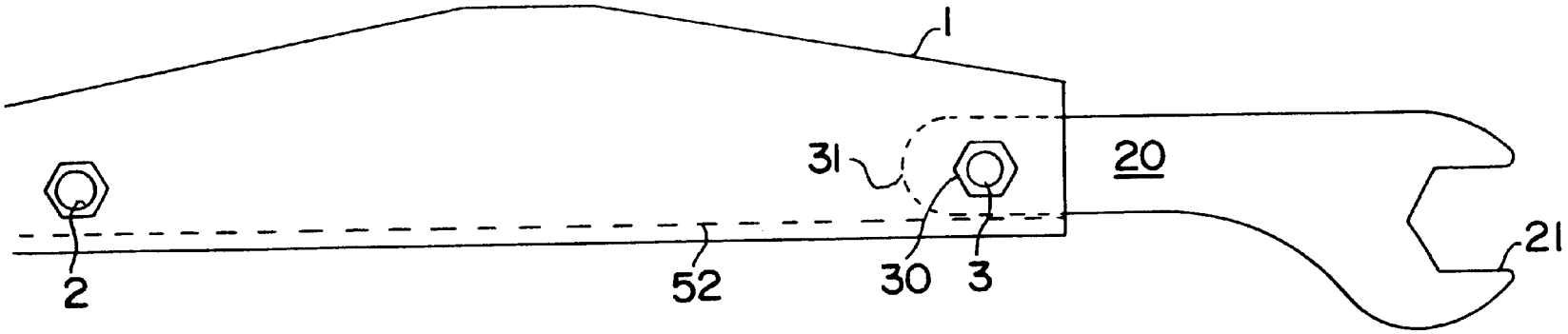
FIG. 1A is a side plan view of a hand tool embodying the present invention, showing a single open wrench in the locked position.
Figure 1B:
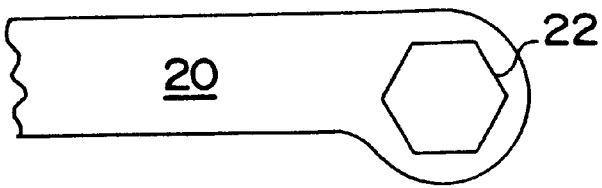
FIG. 1B is a side plan view of a box end head of a wrench which may be utilized in a hand tool of the present invention.
Figure 2A:
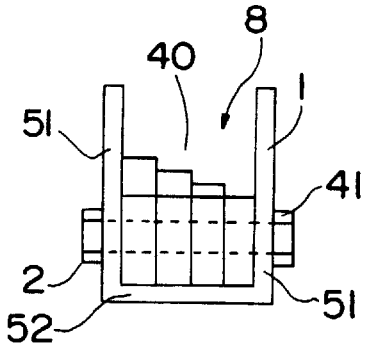
FIGS. 2A and 2B are opposite end views of a hand tool embodying the present invention showing different sized wrenches housed between the side walls of the handle.
Figure 2B:
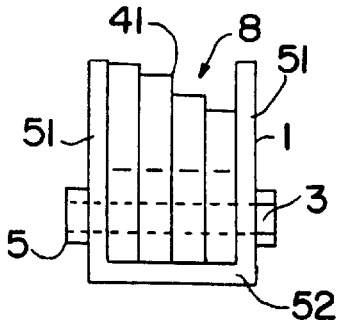
Figure 3:
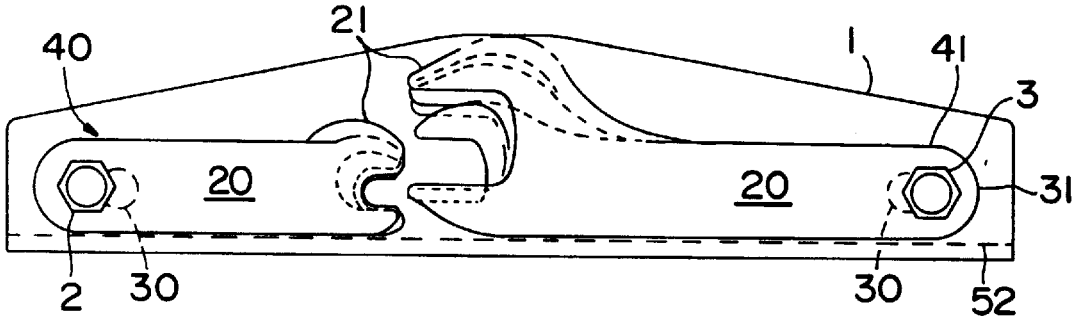
FIG. 3 is a side view of a hand tool embodying the present invention showing a plurality of wrenches in the closed and unlocked position.

Referring to the Figures, a multi-wrench tool set in accordance with a preferred embodiment of the present invention is generally comprised of a body portion having a generally U-shaped cross-section 1, one or more pivot pins 2 and 3, and one or more sets of wrenches (40 and 41 as shown in FIGS. 2A and 2B). Each wrench is comprised of a shank portion 20, a working tip, such as a crescent type wrench head 21 or box end wrench head 22 (FIGS. 1A and 1B), and a longitudinal locking slot 30.

Figure 5A:
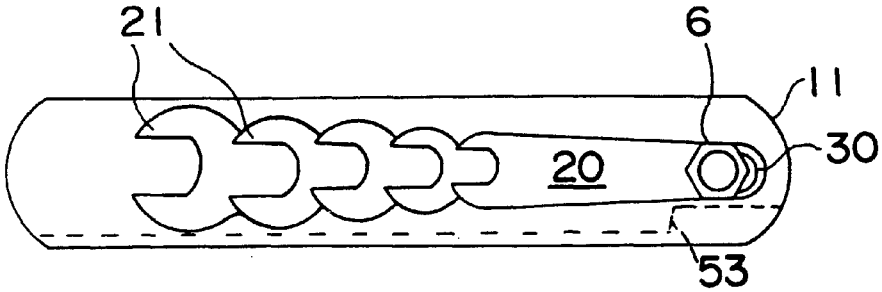
FIG. 5A is a side view of an alternative embodiment of the present invention utilizing a single pin for mounting the wrenches.
Figure 5B:
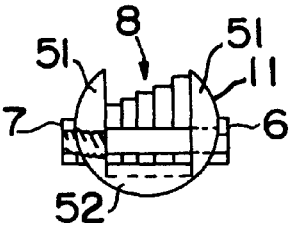
FIG. 5B is an end view of an alternative embodiment of the present invention showing different sized wrenches pivotably mounted on a single pin.

A multi-wrench tool of the present invention, preferably comprises a one piece body portion as shown in FIGS. 2A and 2B. The body preferably comprises side walls 51 and a bottom base 52 forming a channel 8 (FIGS. 2A, 2B and 5B) having a U-shaped cross section. The outer surface of the side walls 51 and bottom base 52 may be flat, as shown in FIGS. 2A and 2B, or curved such as is generally shown in FIG. 5B. The elongated body portion 1, is preferably an integral one-piece machined casing of aluminum or steel, but may optionally be comprised of two or more pieces held together as is known in the art, such as is shown, for example, in the design of U.S. Pat. No. 2,804,970. The inner surface of the bottom base 52 may be flat as shown in FIG. 1, curved, or comprise a shoulder 53 as shown in FIG. 5A. A curved bottom or one having a shoulder such as is shown in FIG. 5*a* allows the wrench heads 20 or 21 to be centered within the channel 8 when the wrenches are in the closed position.

In the preferred embodiment, a pair of pivot pins 2 and 3, are extended through the U-shape channel 8 near either end of the tool body 1. The pins are, however, set back from the end of the channel 8 to allow the shank 20 to be biased against the channel bottom base 52 to prevent the shank 20 from pivoting further about the pins 2 and 3 in the opening direction.

Figure 4:
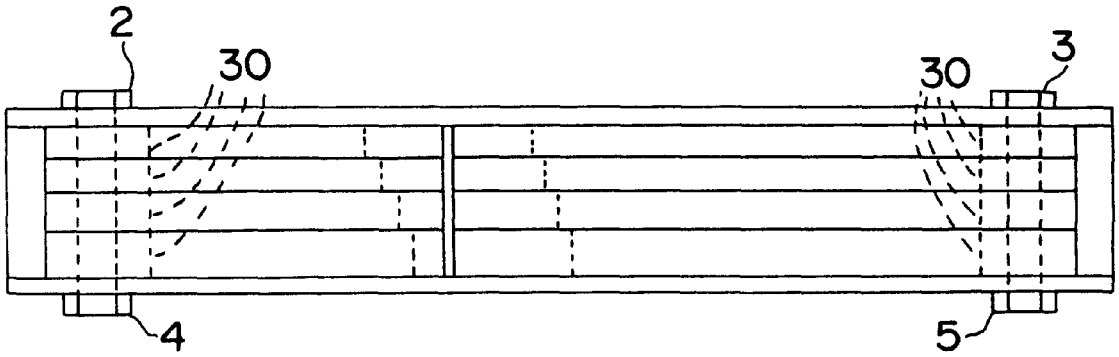
FIG. 4 is a top plan view of a hand tool embodying the present invention.

The pins 2 and 3, preferably comprise a hex head or button head allen bolt which are secured with a locking nut 4 and 5 of FIG. 4. A spring washer (not shown) may optionally be used within the U-shaped channel 8 to tightly hold the sets of wrenches 40 and 41 in FIGS. 2A and 2B. The bolts are typically 3/16" by 1 3/8", but may be modified to accommodate different size tools. A first set 40 and second set 41 of wrenches (FIGS. 2A and 2B) are rotatably held by pins 2 and 3 respectively. Alternatively, as shown in FIGS. 5A and 5B, a single set of wrenches may be rotatably held using a single pivot pin 6.

Each wrench comprises a working tip, such as for example a crescent wrench tip 21 or a boxed end wrench tip 22 and a shank 20. A longitudinal slot 30, having a proximate portion near the shank end 31 and a distal portion towards the working tip end, is cut from the shank end. The pin (2 and 3 in FIG. 1) is positioned within the slot 30.

Figure 6A:
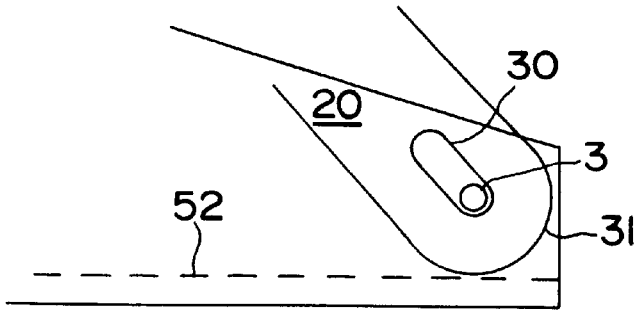
FIGS. 6A, 6B, 6C and 6D show side views of a hand tool constructed in accordance with the present invention.
Figure 6B:
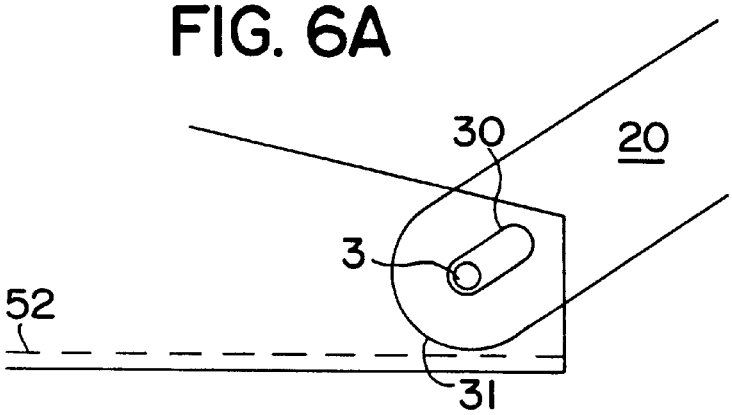
Figure 6C:
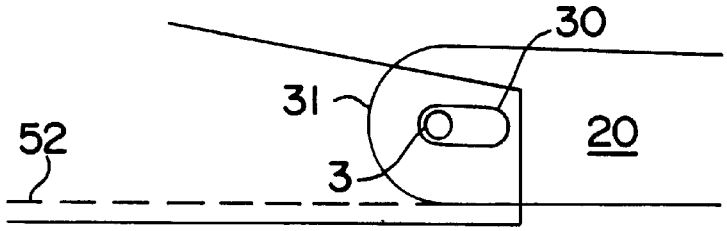
Figure 6D:
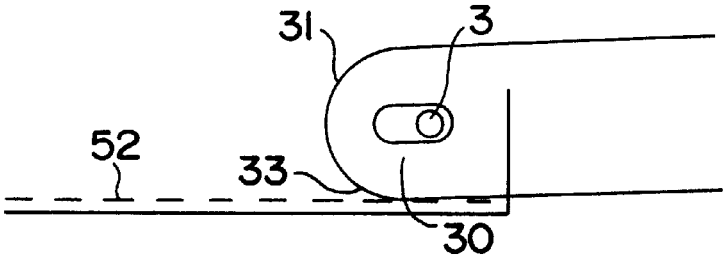

As shown in FIGS. 6A, 6B and 6C, shank 20 includes a curved end 31 having a radius allowing the shank to freely pivot about pivot pin (3 in FIGS. 6A, 6B, 6C and 6D) when the pivot pin is positioned at the proximate end (as shown in FIGS. 6A, 6B and 6C) of locking slot 30. The shank end 31 preferably has radius approximately equal to the distance between the center of the pivot and the surface of the bottom base 52, and a center of curvature at said proximate end of the longitudinal slot. This allows the shank 20 to smoothly pivot about the pivot pin. When the shank is pivoted to the fully extended position (shown in FIG. 6C), it may be pushed back, relative to the tool body 1, forcing the pin into the distal end of the longitudinal slot (shown in FIG. 6D). This prevents the shank 20 from rotating about the pivot pin 3 by biasing the lower portion 33 of shank 20 against the surface of the bottom base 52.

The foregoing description and figures have been presented for purposes of illustration and description. It is not intended to be exhaustive or to limit the invention to the precise forms disclosed. Obvious modifications or variations will be apparent in light of the above teachings.

What is claimed is:

1. A hand tool comprising, an elongated body having a channel bottom and two side walls defining a channel; at least one pivot pin extending across said channel a predetermined distance above said channel bottom; at least one wrench contained and housed within said elongated body, said wrench comprising a shank portion and a working tip portion, said shank portion including a longitudinal slot having a proximate portion and a distal portion, said shank portion comprising a curved end having a radius equal to said predetermined distance and a center of curvature approximately at said proximate portion of said longitudinal slot, said pivot pin being slidably disposed within said longitudinal slot, said shank portion being freely rotatable about said pivot pin when said pivot pin is slidably positioned within said proximate portion of said longitudinal slot, said shank portion being fixedly biased against said channel bottom when said pivot pin is slidably positioned within said distal portion of said longitudinal slot, said channel bottom comprising a raised shoulder proximate to said at least one pivot pin being set back from the end of said channel whereby said working tip portion may be centered along a longitudinal axis of said elongated body when said wrench is in a closed position, and said shank portion may be fixedly biased against shoulder when said pivot pin is in said distal portion of said longitudinal slot.

2. A hand tool comprising, an elongated body having a channel bottom and two side walls defining a channel having a first end and second end, a first pivot pin extending across said channel proximate to said first end a predetermined distance above said channel bottom, a second pivot pin extending across said channel proximate to said second end a predetermined distance above said channel bottom, a first set of varying sized wrenches contained and housed in parallel relationship within said elongated body and being rotably secured to said first pivot pin, and a second set of varying sized wrenches contained and housed in parallel relationship within said elongated body rotably secured to said second pivot pin, each said wrench comprising a shank portion and a working tip portion, said shank portion including a longitudinal slot having a proximate portion and a distal portion, said shank portion further comprising a curved end having a radius approximately equal to said predetermined distance and a center of curvature approximately at said proximate portion of said longitudinal slot, said channel bottom comprising a raised shoulder proximate to said pivot pins, said pivot pins being set back from the respective ends of said channel whereby said working tip portions may be centered along a longitudinal axis of said elongated body when any of said wrenches are in a closed position and said shank portions may be fixedly biased against said shoulder when at least one of said pivot pins is in said distal portion of said longitudinal slot, each pivot pin being slidably disposed within said longitudinal slots of said sets of wrenches, each said wrench being freely rotatable about said pivot pin when said pivot pin is slidably positioned within said proximate portions of said longitudinal slot of said wrench and said wrench being fixedly biased against said channel bottom when said pivot pin is slidably positioned within said distal portion of said longitudinal slot of said wrench.

* * * * *